US010414201B2

(12) United States Patent
Chen

(10) Patent No.: US 10,414,201 B2
(45) Date of Patent: Sep. 17, 2019

(54) PRESSURE REGULATING DEVICE FOR WRITING TOOL AND WRITING TOOL HAVING THE SAME

(71) Applicant: SDI CORPORATION, Chang Hua (TW)

(72) Inventor: Szu-Yu Chen, Chang Hua (TW)

(73) Assignee: SDI CORPORATION, Chang Hua (TW)

( * ) Notice: Subject to any disclaimer, the term of this patent is extended or adjusted under 35 U.S.C. 154(b) by 42 days.

(21) Appl. No.: 15/952,847

(22) Filed: Apr. 13, 2018

(65) Prior Publication Data

US 2019/0143739 A1 May 16, 2019

(30) Foreign Application Priority Data

Nov. 10, 2017 (TW) ..... 106138887 A

(51) Int. Cl.

| | |
|---|---|
| ***B43K 5/02*** | (2006.01) |
| ***B43K 7/08*** | (2006.01) |
| ***B43K 1/00*** | (2006.01) |
| ***B43K 5/06*** | (2006.01) |

(52) U.S. Cl.

CPC ..... *B43K 5/02* (2013.01); *B43K 1/006* (2013.01); *B43K 5/06* (2013.01); *B43K 7/08* (2013.01)

(58) Field of Classification Search

CPC . B43K 5/02; B43K 7/08; B43K 1/006; B43K 5/065; B43K 5/005; B43K 5/04; B43K 5/08; B43K 5/10; B43K 5/12; B43K 7/005; B43K 7/02; B43K 7/03; B43K 7/035; B43K 8/003; B43K 29/00

See application file for complete search history.

(56) References Cited

U.S. PATENT DOCUMENTS

| | | | | |
|---|---|---|---|---|
| 2,143,601 A | | 1/1939 | Iversen | |
| 2,670,710 A | | 3/1954 | Zepelovitch | |
| 3,854,826 A | * | 12/1974 | Adams | B43K 7/035 401/188 R |
| 4,973,180 A | | 11/1990 | Hori | |

(Continued)

FOREIGN PATENT DOCUMENTS

| | | |
|---|---|---|
| CA | 2965270 A1 | 4/2016 |
| CN | 201405605 Y | 2/2010 |
| DE | 9305608 U1 | 8/1994 |

(Continued)

*Primary Examiner* — David J Walczak

(74) *Attorney, Agent, or Firm* — Sinorica, LLC

(57) ABSTRACT

A pressure regulating device for a writing tool has a deformable member. Minor air pressure variations in a pen tube of the writing tool can be regulated by deformation of the deformable member. Major air pressure variations in the pen tube can also be regulated by movement of the pressure regulating device. Thus, the pen tube of the writing tool can avoid internal air pressure imbalance caused by external high temperature or low air pressure. Before the writing tool is shipped from a manufacturer, the deformable member is pressurized in advance, such that the minor air pressure variation formed when a pen cap caps the writing tool offsets the air pressure pre-applied to the deformable member. Accordingly, ink inside an internal chamber does not spout out upon removal of the pen cap and the ink will not be overly dispensed or leak during writing.

20 Claims, 10 Drawing Sheets

(56) References Cited

U.S. PATENT DOCUMENTS

| | | | | |
|---|---|---|---|---|
| 6,729,787 | B2 * | 5/2004 | Usami | A45D 34/041 401/141 |
| 7,637,680 | B2 * | 12/2009 | Yoneda | B43K 7/08 401/141 |

FOREIGN PATENT DOCUMENTS

| | | | |
|---|---|---|---|
| FR | 933116 | A | 4/1948 |
| FR | 1058192 | A | 3/1954 |
| GB | 503994 | A | 4/1939 |
| JP | 1178350 | A | 3/1999 |
| LU | 28632 | A1 | 10/1947 |
| WO | 00/03881 | A1 | 1/2000 |
| WO | 2016/062972 | A1 | 4/2016 |

* cited by examiner

PRESSURE REGULATING DEVICE FOR WRITING TOOL AND WRITING TOOL HAVING THE SAME

BACKGROUND OF THE INVENTION

1. Field of the Invention

The present invention relates to a pressure regulating device for a writing tool that can directly supply ink, especially to a pressure regulating device that can regulate pressure by sliding relative to a writing tool and/or by deformation. The present invention also relates to a writing tool having the pressure regulating device.

2. Description of the Prior Art(s)

A conventional writing tool that directly supplies ink has a pen tube and a slidable divider mounted in the pen tube and dividing an interior of the pen tube into an upper portion and a lower portion. The lower portion defines an internal chamber which is used for accommodating ink and contains a little air. The upper portion defines an external communication chamber which communicates with an exterior of the pen tube via a vent hole formed at a distal end of the pen tube. When the ink is gradually consumed, the slidable divider gradually slides downward to fill space which was previously occupied by the consumed ink. However, the slidable divider is only able to slowly move slightly according to consumption of the ink is unable to regulate an internal pressure of the pen tube in response to larger pressure variations. Specifically, the larger pressure variations may happen in the following situations as examples.

1. When the conventional writing tool is placed at a high temperature, air inside the pen tube may expand due to heat. Since the air inside the internal chamber of the conventional writing tool does not communicate with the exterior of the pen tube when a pen cap caps the pen tube, an air pressure inside the internal chamber of the conventional writing tool is increased due to expansion of the heated air, thus causing a pressure difference between the internal chamber of the conventional writing tool and the exterior of the pen tube. At this moment, if the internal pressure of the pen tube of the conventional writing tool is not properly regulated, the ink may spout out upon removal of the pen cap. In another possible scenario, as the conventional writing tool is used under a high temperature, the air pressure that is formed by thermal expansion of the air may cause the ink to be overly dispensed and leak. Moreover, when the ink is gradually consumed during writing, the slidable divider though gradually slides downward to fill the space occupied previously by the consumed ink, the slidable divider rubs against an inner sidewall of the pen tube, such that the consumption amount of the ink does not correspond to movement amount of the slidable divider. Therefore, as the ink is gradually consumed, the air inside the internal chamber increases. Accordingly, the thermally expanded air has a greater influence on the air pressure inside the internal chamber, and ink leakage will become more.

2. As the pen cap caps the pen tube, the air pressure inside the internal chamber of the conventional writing tool also increases slightly, adversely affecting stability of the conventional writing tool during transportation. Variations in temperature and air pressure to a certain extent are inevitable during transportation, e.g. an airplane is taking off or landing, or a vehicle is undergoing shocks and vibrations over rough terrain. If the internal pressure of the conventional writing tool is not properly regulated, owing to the air pressure variation, the pen cap might be detached or even ejected from the pen tube, or the ink might be overly dispensed and leak, thus causing stains on the goods.

SUMMARY OF THE INVENTION

In view of the aforementioned shortcomings, the present invention provides a pressure regulating device for a writing tool and a writing tool having the pressure regulating device to overcome the shortcomings. The pressure regulating device is able to regulate an internal air pressure of the writing tool in response to minor and major pressure variations, thus ensuring that the internal air pressure is balanced.

In order to achieve the above-mentioned objective, the pressure regulating device for the writing tool in accordance with the present invention is slidably mounted in a pen tube of the writing tool and divides an interior space of the pen tube into an internal chamber and an external communication chamber. The pressure regulating device has a tubular member provided with an outer periphery abutting on an inner sidewall of the pen tube; and a deformable member disposed in the tubular member. When a pressure difference between the internal chamber and the external communication chamber is larger than a first predetermined value, the deformable member deforms toward the external communication chamber. When the pressure difference between the internal chamber and the external communication chamber is larger than a second predetermined value, the pressure regulating device slides, relative to the pen tube, toward the external communication chamber. The second predetermined value is larger than the first predetermined value.

In order to achieve the above-mentioned objective, the writing tool in accordance with the present invention has a pen tube, the pressure regulating device as described above, and a nib assembly mounted to an open end of the pen tube of the pressure regulating device and beside the internal chamber of the pen tube. The deformable member of the pressure regulating device is pressurized in advance, thereby the deformable member for resistance against its deformation toward the external communication chamber of the pen tube.

The pressure regulating device and the writing tool of the present inventions have the following advantages. With the deformable member of the pressure regulating device, a minor air pressure variation can be regulated by deformation of the deformable member. When the air pressure variation is major, the air pressure variation can also be regulated by movement of the pressure regulating device. Thus, regardless of any degree of air pressure variation, the pressure regulating device can regulate the air pressure inside the pen tube of the writing tool for balance of the air pressure, thereby avoiding internal air pressure imbalance caused by an external high temperature or an external low air pressure. Accordingly, ink inside the internal chamber will neither spout out upon removal of the pen cap nor be overly dispensed or leak during writing.

Moreover, before the writing tool of the present invention is shipped out from a manufacturer, the deformable member is pressurized in advance, thereby enabling the deformable member for resistance against its deformation toward the external communication chamber. For instance, the pressure regulating device is pressurized to allow the deformable member to protrude toward the internal chamber. Thus, when a pen cap caps the writing tool, a minor air pressure variation that happens to offset the air pressure pre-applied to the deformable member, so the internal air pressure of the writing tool is balanced. Accordingly, the writing tool can be transported in such a state that the internal and external air pressures are balanced therebetween, and the influence resulting from the external temperature and the air pressure can be reduced to a minimum degree. Thus, the pen cap will not be detached or ejected from the pen tube due to the air pressure variation caused by shocks and vibrations during transportation. The ink will not be overly dispensed for leakage, so the goods will not be stained and remain intact.

Preferably, when the pressure difference between the internal chamber and the external communication chamber is smaller than the first predetermined value, the deformable member protrudes toward the internal chamber; when the pressure difference between the internal chamber and the external communication chamber is larger than the first predetermined value, the deformable member protrudes toward the external communication chamber.

Preferably, the deformable member is hemispherical in shape.

Preferably, the deformable member is a diaphragm and has a first piece and a second piece; an end of the first piece is connected to an end of the second piece; another end of the first piece is connected to an inner sidewall of the tubular member; another end of the second piece is formed as a closed end; and an inner diameter of the first piece is larger than that of the second piece. When the deformable member protrudes toward the internal chamber, both the first piece and the second piece protrude toward the internal chamber. When the deformable member protrudes toward the external communication chamber, both the first piece and the second piece protrude toward the external communication chamber.

Preferably, the deformable member protrudes toward the external communication chamber and encloses an inner space. When the pressure difference between the internal chamber and the external communication chamber is larger than the first predetermined value, the deformable member deforms to expand toward the external communication chamber, such that the inner space in this state is volumetrically larger than the inner space when the pressure difference between the internal chamber and the external communication chamber is smaller than the first predetermined value.

Preferably, the deformable member is a resilient bag that can be expanded by air pressure. When the pressure difference between the internal chamber and the external communication chamber is smaller than the first predetermined value, the deformable member shrinks. When the pressure difference between the internal chamber and the external communication chamber is larger than the first predetermined value, the deformable member expands toward the external communication chamber.

Preferably, the deformable member is formed as a tubular bellows; an end of the deformable member is connected to the inner sidewall of the tubular member, and another end of the deformable member is formed as a closed end. When the pressure difference between the internal chamber and the external communication chamber is larger than the first predetermined value, the deformable member expands and elongates, such that the deformable member in this state is longer than the deformable member when the pressure difference between the internal chamber and the external communication chamber is smaller than the first predetermined value.

Preferably, an external temperature variation that corresponds to the first predetermined value ranges from 2° C. to 4° C., and an external temperature variation that corresponds to the second predetermined value ranges from 5° C. to 7° C.

Preferably, X is defined as a diameter of a widest part of the deformable member, Y is defined as a thickness of the deformable member, and a relation between the diameter of the widest part of the deformable member and the thickness of the deformable member is expressed by a formula as follows:

$$Y=0.09X-0.1.$$

Preferably, the thickness of the deformable member ranges from 0.35 mm to 0.8 mm, and the diameter of the widest part of the deformable member ranges from 5 mm to 10 mm.

Preferably, the outer periphery of the tubular member includes an outer sidewall and two annular flanges. The annular flanges are spaced from each other, are formed around and protrude from the outer sidewall of the outer periphery of the tubular member, and abut on the inner sidewall of the pen tube.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
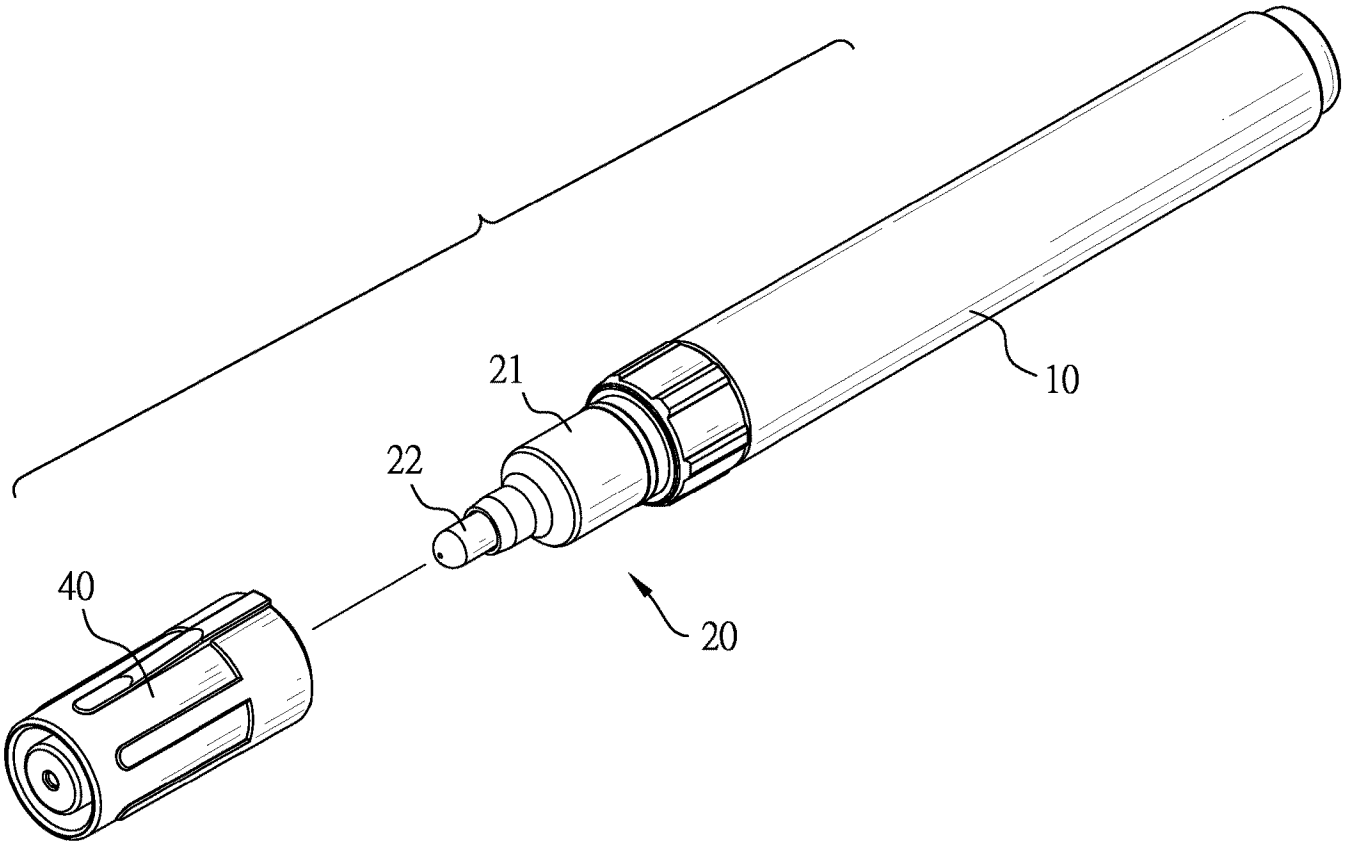
FIG. 1 is a perspective view of a writing tool in accordance with the present invention.
Figure 2:
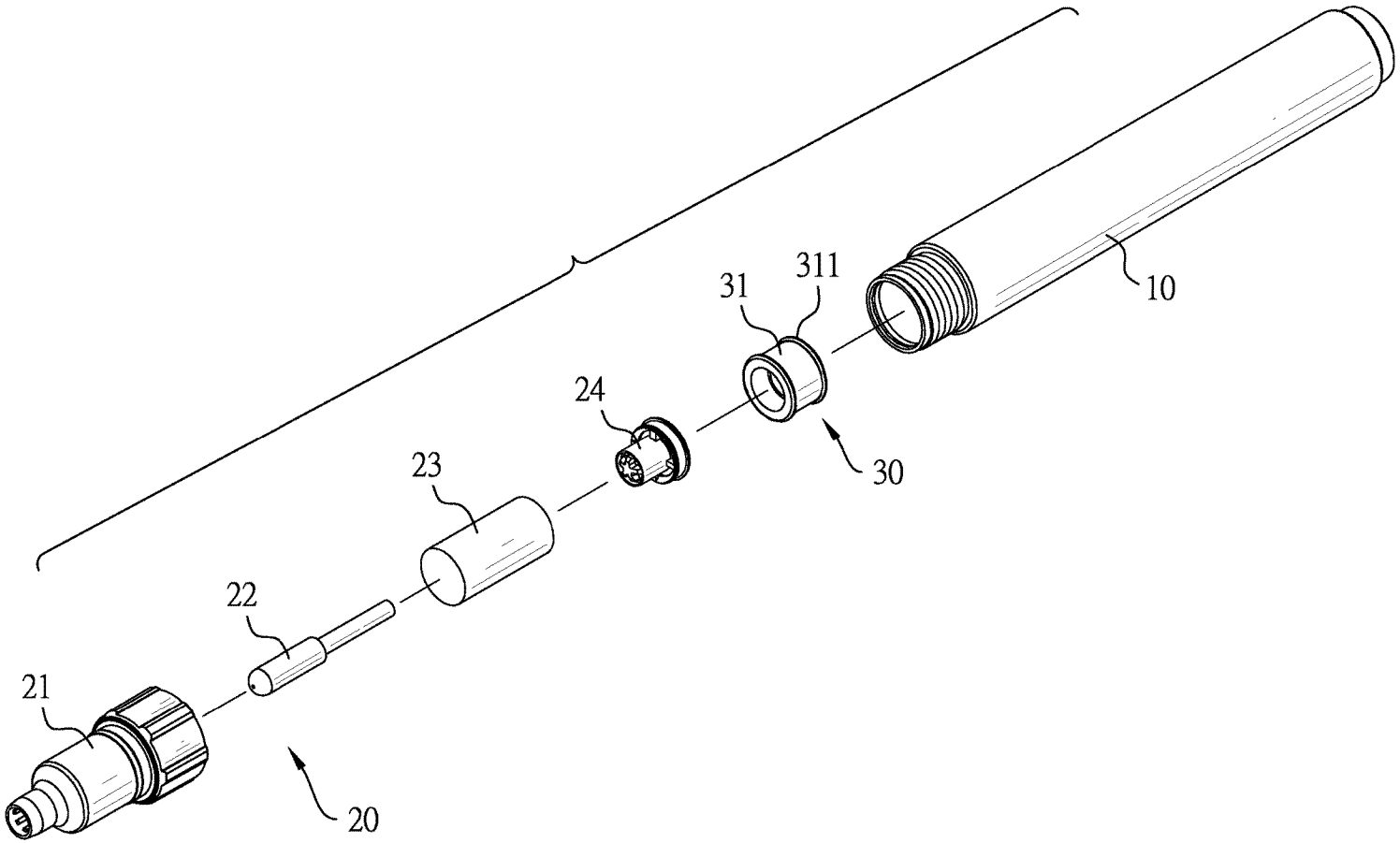
FIG. 2 is an exploded perspective view of the writing tool indicated in FIG. 1.
Figure 3:
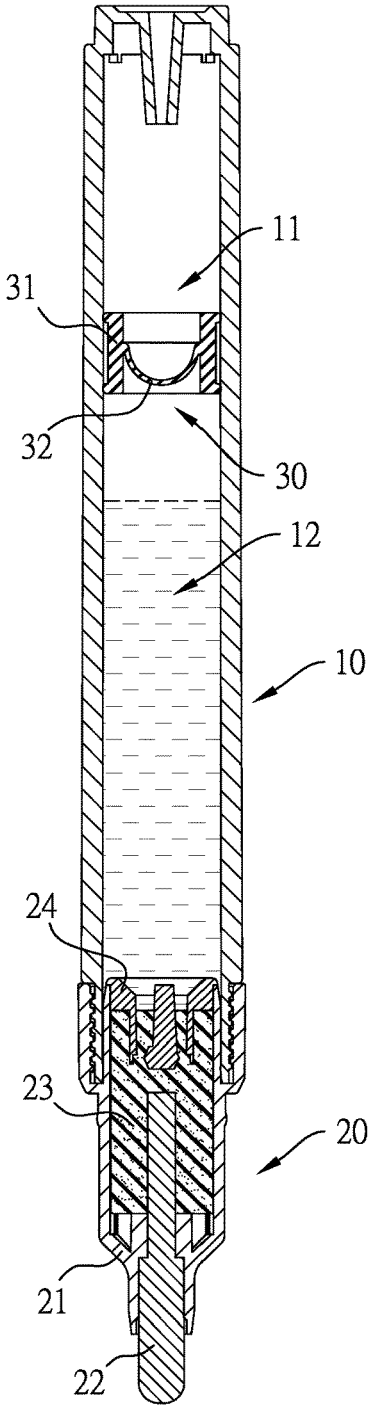
FIGS. 3 to 5 are operational schematic views of the writing tool.

With reference to FIGS. 1 to 3, a writing tool in accordance with the present invention comprises a pen tube 10, a nib assembly 20, and a pressure regulating device 30 that is able to regulate air pressure. Specifically, the writing tool in accordance with the present invention is a writing tool that directly supplies ink and may be, but not limited to, a marker pen, a whiteboard pen, or the like.

In a preferred embodiment, the pen tube 10 has an interior space, an open end, and a vent hole. The open end and the vent hole are located at two opposite ends of the pen tube 10, respectively. In the preferred embodiment, a diameter of the pen tube 10 ranges from, but not limited to, 4 mm to 25 mm.

The nib assembly 20 is mounted to the open end of the pen tube 10. In the preferred embodiment, the nib assembly 20 includes a nib housing 21, a nib 22, an internal wadding 23, and a nib holder 24. The nib housing 21 is mounted to the open end of the pen tube 10 and has an inner end extending into the pen tube 10. The nib 22 is mounted in the nib housing 21 and has an end extending out of the nib housing 21. The internal wadding 23 is mounted in the nib housing 21 and around another end of the nib 22. The nib holder 24 is mounted to the inner end of the nib housing 21, inserted into the internal wadding 23, and securely holds the internal wadding 23. Detailed structure and structural relationships of the nib assembly 20 are conventional and not limited to the above-mentioned ones.

Figure 6:
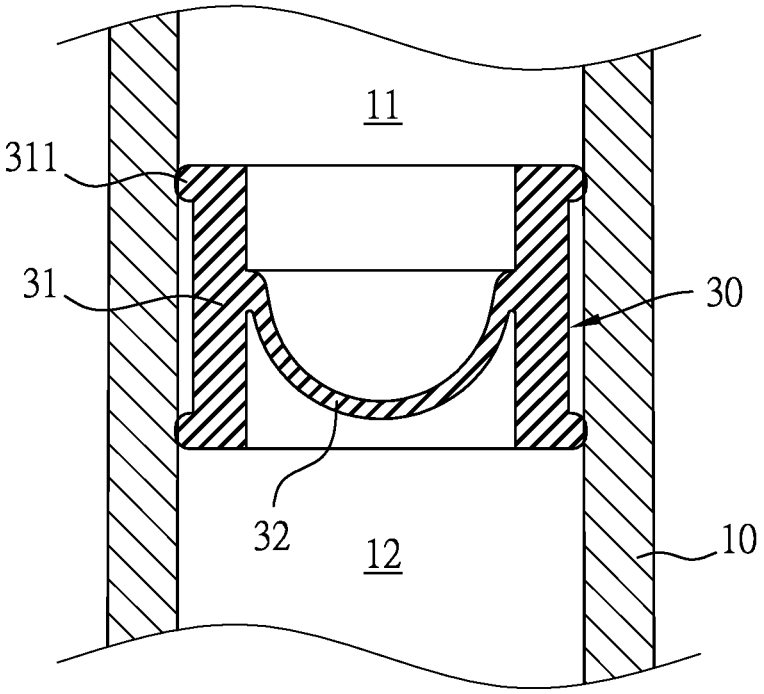
FIGS. 6 and 7 are operational schematic views of a pressure regulating device of the writing tool in accordance with a first embodiment of the present invention.

With further reference to FIGS. 2 and 6, the pressure regulating device 30 is slidably mounted in the pen tube 10 and divides the interior space of the pen tube 10 into an external communication chamber 11 and an internal chamber 12. The internal chamber 12 is disposed closer to the nib assembly 20 than the external communication chamber 11 and is filled with ink and air. The external communication chamber 11 communicates with an exterior of the pen tube 10 via the vent hole. Thus, an air pressure in the external communication chamber 11 and an air pressure of the exterior of the pen tube 10 are balanced. The pressure regulating device 30 includes a tubular member 31 and a deformable member 32.

The tubular member 31 is provided with an outer periphery abutting on an inner sidewall of the pen tube 10. In the preferred embodiment, the outer periphery of the tubular member 31 includes an outer sidewall and two annular flanges 311. The annular flanges 311 are spaced from each other, are formed around and protrude from the outer sidewall of the outer periphery of the tubular member 31, and abut on the inner sidewall of the pen tube 10. Specifically, the annular flanges 311 are disposed adjacent to two opposite open ends of the tubular member 31, respectively. However, the tubular member 31 is not structurally limited to the above-mentioned one. For example, the annular flanges 311 could be omitted, and the tubular member 31 can make its outer sidewall or other structures directly abut on the inner sidewall of the pen tube 10.

The deformable member 32 is a diaphragm and disposed in the tubular member 31. When an air pressure in the internal chamber 12 of the pen tube 10 is larger than the air pressure in the external communication chamber 11, if the pressure difference between the internal chamber 12 and the external communication chamber 11 is larger than a first predetermined value, the deformable member 32 will deform toward the external communication chamber 11, as shown in FIG. 4; if the pressure difference between the internal chamber 12 and the external communication chamber 11 is larger than a second predetermined value, the whole pressure regulating device 30 will slide relative to the pen tube 10 toward the external communication chamber 11, as shown in FIG. 5, wherein the second predetermined value is larger than the first predetermined value.

Figure 4:
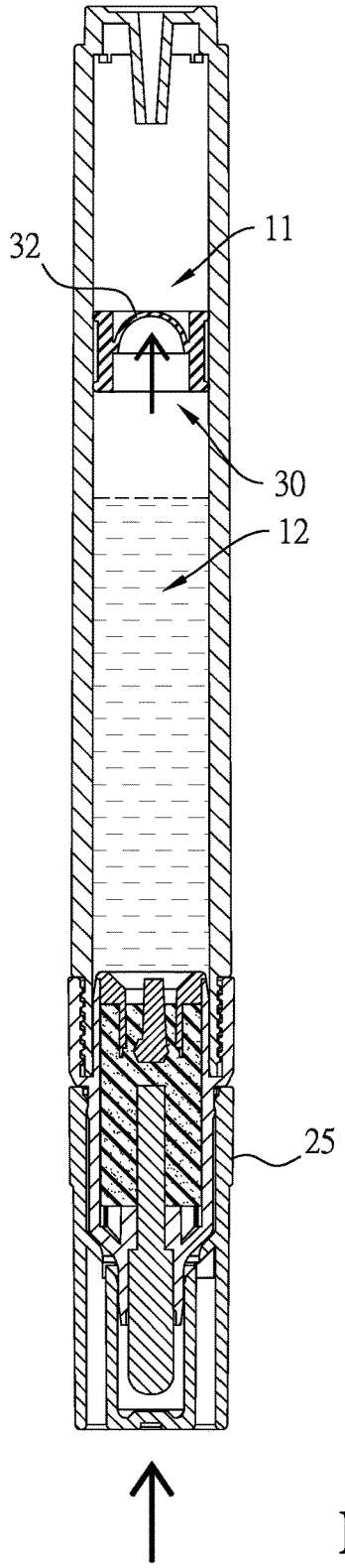
Figure 5:
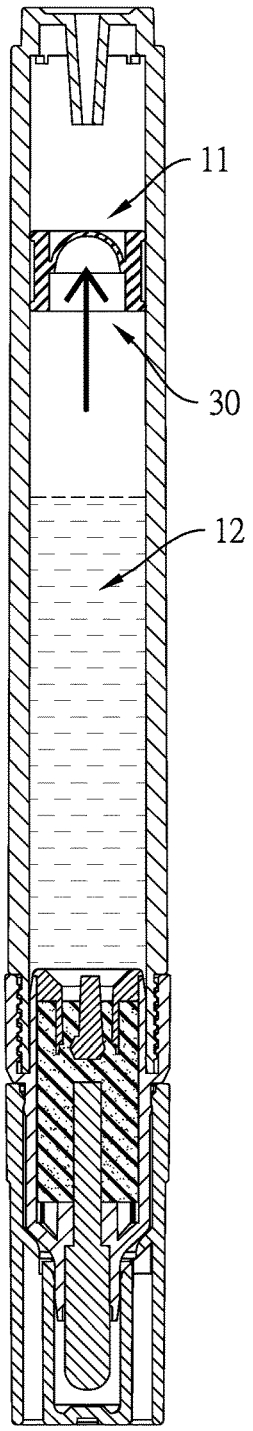

With further reference to FIGS. 3 to 5, in other words, when the pressure difference between the internal chamber 12 and the external communication chamber 11 gradually increases, the deformable member 32 gradually deforms toward the external communication chamber 11. As the deformable member 32 deforms to an extreme extent, if the pressure difference continuously increases, the whole pressure regulating device 30 will slide relative to the pen tube 10 toward the external communication chamber 11. Thus, a minor air pressure variation can be regulated by deformation of the deformable member 32. When the air pressure variation is too large, the air pressure variation can also be regulated by movement of the pressure regulating device 30.

The deformable member 32 may have alternative structures which can achieve the above-mentioned effects. For example, there are two configurations for the deformable member 32 as recited below.

With reference to FIGS. 6, 7, 9, and 10, the deformable member 32, 32A of the first configuration protrudes toward the internal chamber 12 or protrudes toward the external communication chamber 11 as the air pressure varies. More precisely, when the pressure difference between the internal chamber 12 and the external communication chamber 11 is smaller than the first predetermined value, the deformable member 32, 32A protrudes toward the internal chamber 12; when the pressure difference between the internal chamber 12 and the external communication chamber 11 is larger than the first predetermined value, the deformable member 32, 32A protrudes toward the external communication chamber 11. Specifically, there are two preferred embodiments for the first configuration of the deformable member 32, 32A as set forth below.

Figure 7:
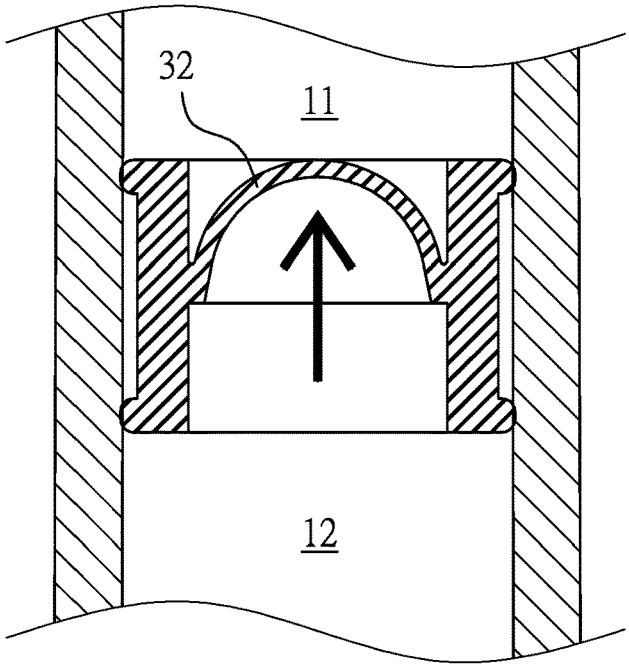

With reference to FIGS. 2, 6, and 7, the deformable member 32 may be hemispherical in shape and a direction in which the hemispherical deformable member 32 protrudes varies with the circumstances mentioned in the previous paragraph.

Figure 8:
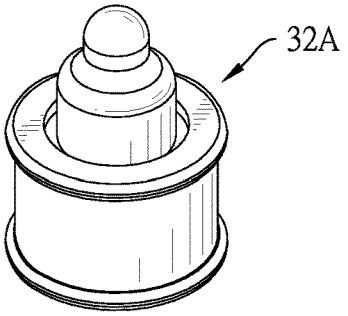
FIG. 8 is a perspective view of a pressure regulating device of the writing tool in accordance with a second embodiment of the present invention.
Figure 9:
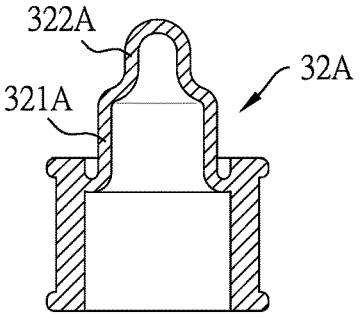
FIGS. 9 and 10 are operational schematic views of the pressure regulating device indicated in FIG. 8.
Figure 10:
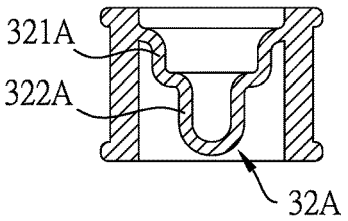

With further reference to FIGS. 8 to 10, the deformable member 32A may have a first piece 321A and a second piece 322A. An end of the first piece 321A is connected to an end of the second piece 322A. Another end of the first piece 321A is connected to an inner sidewall of the tubular member. Another end of the second piece 322A is formed as a closed end. An inner diameter of the first piece 321A is larger than that of the second piece 322A. As shown in FIG. 10, when the deformable member 32A protrudes toward the internal chamber 12, both the first piece 321A and the second piece 322A protrude toward the internal chamber 12. As shown in FIG. 9, when the deformable member 32A protrudes toward the external communication chamber 11, both the first piece 321A and the second piece 322A protrude toward the external communication chamber 11.

With further reference to FIGS. 11 to 16, in the second configuration of the deformable member 32B, 32C, an inner space enclosed by the deformable member 32B, 32C volumetrically varies with the air pressure. More precisely, the deformable member 32B, 32C keeps protruding toward the external communication chamber 11 and encloses said inner space. When the pressure difference between the internal chamber 12 and the external communication chamber 11 is larger than the first predetermined value, the deformable member 32B, 32C deforms to expand toward the external communication chamber 11, such that the inner space in this state is volumetrically larger than the inner space when the pressure difference between the internal chamber 12 and the external communication chamber 11 is smaller than the first predetermined value.

In other words, when the pressure difference between the internal chamber 12 and the external communication chamber 11 is smaller than the first predetermined value, the deformable member 32B, 32C shrinks; when the pressure difference between the internal chamber 12 and the external communication chamber 11 is larger than the first predetermined value, the deformable member 32B, 32C expands. Specifically, the second configuration of the deformable member 32B, 32C includes the following two embodiments.

Figure 11:
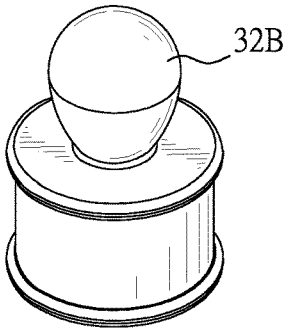
FIG. 11 is a perspective view of a pressure regulating device of the writing tool in accordance with a third embodiment of the present invention.
Figure 12:
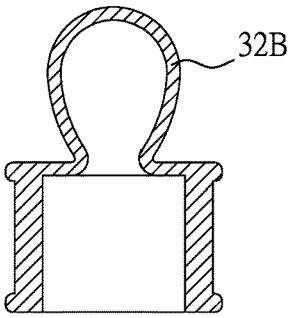
FIGS. 12 and 13 are operational schematic views of the pressure regulating device indicated in FIG. 11.
Figure 13:
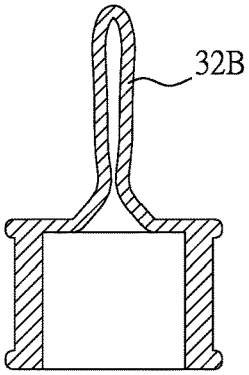

With reference to FIGS. 11 to 13, the deformable member 32B may be a resilient bag that can be expanded by air pressure. As shown in FIG. 13, when the pressure difference between the internal chamber 12 and the external communication chamber 11 is smaller than the first predetermined value, the deformable member 32B shrinks. As shown in FIG. 12, when the pressure difference between the internal chamber 12 and the external communication chamber 11 is larger than the first predetermined value, the deformable member 32B expands toward the external communication chamber 11.

Figure 14:
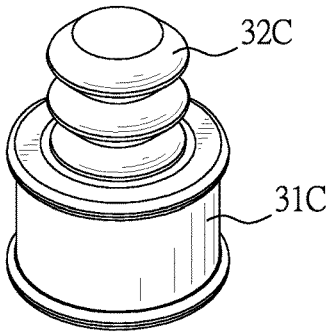
FIG. 14 is a perspective view of a pressure regulating device of the writing tool in accordance with a fourth embodiment of the present invention.
Figure 15:
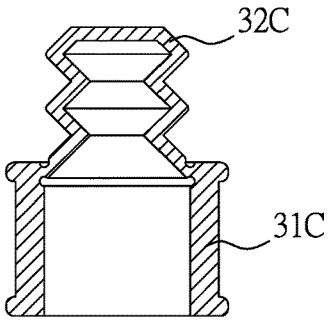
FIGS. 15 and 16 are operational schematic views of the pressure regulating device indicated in FIG. 14.
Figure 16:
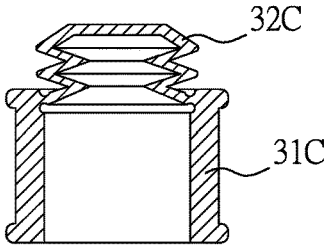

With further reference to FIGS. 14 to 16, the deformable member 32C is formed as a tubular bellows. An end of the deformable member 32C is connected to the inner sidewall of the tubular member 31C. Another end of the deformable member 32C is formed as a closed end. As shown in FIG. 16, when the pressure difference between the internal chamber 12 and the external communication chamber 11 is smaller than the first predetermined value, the deformable member 32C is compressed and shortened. As shown in FIG. 15, when the pressure difference between the internal chamber 12 and the external communication chamber 11 is larger than the first predetermined value, the deformable member 32C expands and elongates.

All of the deformable members 32, 32A, 32B, 32C of the four aforementioned embodiments can slightly regulate the air pressure by their deformation toward the external communication chamber 11 when the pressure difference between the internal chamber 12 and the external communication chamber 11 is larger than the first predetermined value. However, the deformable members 32, 32A, 32B, 32C are not limited to the aforementioned two configurations and four embodiments as long as the aforementioned objective of the present invention can be achieved.

With further reference to FIG. 6 again, regarding a size of the deformable member 32, in the preferred embodiment, a relation between a diameter of a widest part of the deformable member 32 and a thickness of the deformable member 32 is expressed by a formula: $Y=0.09X-0.1$, wherein X is the diameter of the widest part of the deformable member 32 and Y is the thickness of the deformable member 32. Preferably, the diameter of the widest part of the deformable member 32 ranges from 5 mm to 10 mm, and the thickness of the deformable member 32 ranges from 0.35 mm to 0.8 mm. However, the size of the deformable member 32 is not limited to the above-mentioned ranges and can be adjusted as needed. Moreover, in the preferred embodiment, the deformable member 32 is made of silicon rubber. However, a material that the deformable member 32 is made of is, but not limited to, silicon rubber. The deformable member 32 may be made of any material that is able to achieve the above-mentioned effect of the present invention.

With regard to when the deformable member 32 regulates the pressure difference between the internal chamber 12 and the external communication chamber 11, the first predetermined value and the second predetermined value can be defined by external temperature variations in addition to the air pressure difference. Specifically, the external temperature variation that corresponds to the first predetermined value ranges from 2° C. to 4° C., and is preferably 3° C. ; the external temperature variation that corresponds to the second predetermined value ranges from 5° C. to 7° C., and is preferably 6° C.

For instance, when an external temperature rises from 18° C. to 21° C., the pressure difference between the internal chamber 12 and the external communication chamber 11 can reach the first predetermined value; when the external temperature rises from 18° C. to 24° C., the pressure difference can reach the second predetermined value. For example, when the external temperature rises from 25° C. to 28° C., the pressure difference between the internal chamber 12 and the external communication chamber 11 can reach the first predetermined value; when the external temperature rises from 25° C. to 31° C., the pressure difference can reach the second predetermined value.

With further reference to FIGS. 3 and 6, before the writing tool of the present invention is shipped from a manufacturer, the deformable member 32 is pressurized in advance, thereby enabling the deformable member 32 for resistance against its deformation toward the external communication chamber 11. For instance, in the first configuration of the deformable member 32, 32A of the pressure regulating device 30, the pressure regulating device 30 is pressurized to allow the deformable member 32, 32A to protrude toward the internal chamber 12. Thus, with further reference to FIGS. 4 and 7, when a pen cap 40 caps the writing tool, a minor air pressure variation happens to offset the air pressure pre-applied to the deformable member 32, such that the internal air pressure of the writing tool is balanced. Accordingly, the writing tool can be transported in such a state that the internal and external air pressures are balanced therebetween, and the influence resulting from the external temperature and the air pressure can be reduced to a minimum degree. Thus, the pen cap 40 will not be detached or ejected from the pen tube 10 due to the air pressure variation caused by shocks and vibrations during transportation. The ink will not be overly dispensed for leakage, such that goods will not be stained and remain intact.

Referring to FIG. 5 again, when the external temperature is so high that the air pressure variation inside the writing tool becomes overgreat, the whole pressure regulating device 30 slides relative to the pen tube 10 toward the external communication chamber 11, thereby regulating the air pressure inside the pen tube 10. Minor air pressure variations can be regulated by the deformation of the deformable member 32 and major air pressure variations can be regulated by the movement of the pressure regulating device 30.

Regardless of any degree of the air pressure variation, the pressure regulating device 30 for the writing tool of the present invention can regulate the air pressure inside the pen tube 10 of the writing tool for balance of the air pressure so as to avoid internal air pressure imbalance caused by an external high temperature or an external low air pressure. Accordingly, ink inside the internal chamber 12 will neither spout out upon removal of the pen cap 40 and nor be overly dispensed or leak during writing.

Even though numerous characteristics and advantages of the present invention have been set forth in the foregoing description, together with details of the structure and features of the invention, the disclosure is illustrative only. Changes may be made in details, especially in the matter of shape, size, and arrangement of parts within the principles of the invention to the full extent indicated by the broad general meaning of the terms in which the appended claims are expressed.

What is claimed is:

1. A pressure regulating device for a writing tool, the pressure regulating device slidably mounted in a pen tube of the writing tool for dividing an interior space of the pen tube into an internal chamber and an external communication chamber, the pressure regulating device comprising:

a tubular member provided with an outer periphery abutting on an inner sidewall of the pen tube; and a deformable member disposed in the tubular member;

wherein when a pressure difference between the internal chamber and the external communication chamber is larger than a first predetermined value, the deformable member deforms toward the external communication chamber; and when the pressure difference between the internal chamber and the external communication chamber is larger than a second predetermined value, the pressure regulating device slides toward the external communication chamber relative to the pen tube;

wherein the second predetermined value is larger than the first predetermined value.

2. The pressure regulating device for the writing tool as claimed in claim 1, wherein when the pressure difference between the internal chamber and the external communication chamber is smaller than the first predetermined value, the deformable member protrudes toward the internal chamber; and when the pressure difference between the internal chamber and the external communication chamber is larger than the first predetermined value, the deformable member protrudes toward the external communication chamber.

3. The pressure regulating device for the writing tool as claimed in claim 2, wherein the deformable member is hemispherical in shape.

4. The pressure regulating device for the writing tool as claimed in claim 2, wherein the deformable member has a first piece and a second piece, an end of the first piece is connected to an end of the second piece, another end of the first piece is connected to an inner sidewall of the tubular member, another end of the second piece is formed as a closed end, and an inner diameter of the first piece is larger than that of the second piece;

wherein when the deformable member protrudes toward the internal chamber, both the first piece and the second piece protrude toward the internal chamber; and when the deformable member protrudes toward the external communication chamber, both the first piece and the second piece protrude toward the external communication chamber.

5. The pressure regulating device for the writing tool as claimed in claim 4, wherein an external temperature variation that corresponds to the first predetermined value ranges from 2° C. to 4° C.; and an external temperature variation that corresponds to the second predetermined value ranges from 5° C. to 7° C.

6. The pressure regulating device for the writing tool as claimed in claim 4, wherein X is defined as a diameter of a widest part of the deformable member, Y is defined as a thickness of the deformable member, and a relation between the diameter of the widest part of the deformable member and the thickness of the deformable member is expressed by a formula as follows:

$$Y=0.09X-0.1.$$

7. The pressure regulating device for the writing tool as claimed in claim 6, wherein the thickness of the deformable member ranges from 0.35 mm to 0.8 mm, and the diameter of the widest part of the deformable member ranges from 5 mm to 10 mm.

8. The pressure regulating device for the writing tool as claimed in claim 4, wherein the outer periphery of the tubular member has an outer sidewall and two annular flanges, the annular flanges being spaced from each other, being formed around and protruding from the outer sidewall of the outer periphery of the tubular member, and abutting on the inner sidewall of the pen tube.

9. The pressure regulating device for the writing tool as claimed in claim 1, wherein the deformable member protrudes toward the external communication chamber and encloses an inner space;

wherein when the pressure difference between the internal chamber and the external communication chamber is larger than the first predetermined value, the deformable member deforms to expand toward the external communication chamber, such that the inner space in this state is volumetrically larger than the inner space when the pressure difference between the internal chamber and the external communication chamber is smaller than the first predetermined value.

10. The pressure regulating device for the writing tool as claimed in claim 9, wherein the deformable member is a resilient bag that is expandable subject to air pressure;

wherein when the pressure difference between the internal chamber and the external communication chamber is smaller than the first predetermined value, the deformable member shrinks; and when the pressure difference between the internal chamber and the external communication chamber is larger than the first predetermined value, the deformable member expands toward the external communication chamber.

11. The pressure regulating device for the writing tool as claimed in claim 9, wherein the deformable member is formed as a tubular bellows, an end of the deformable member is connected to an inner sidewall of the tubular member, and another end of the deformable member is formed as a closed end; wherein when the pressure difference between the internal chamber and the external communication chamber is larger than the first predetermined value, the deformable member expands and elongates, such that the deformable member in this state is longer than the deformable member when the pressure difference between the internal chamber and the external communication chamber is smaller than the first predetermined value.

12. The pressure regulating device for the writing tool as claimed in claim 11, wherein an external temperature variation that corresponds to the first predetermined value ranges from 2° C. to 4° C.; and an external temperature variation that corresponds to the second predetermined value ranges from 5° C. to 7° C.

13. The pressure regulating device for the writing tool as claimed in claim 1, wherein X is defined as a diameter of a widest part of the deformable member, Y is defined as a thickness of the deformable member, and a relation between the diameter of the widest part of the deformable member and the thickness of the deformable member is expressed by a formula as follows:

$$Y=0.09X-0.1.$$

14. The pressure regulating device for the writing tool as claimed in claim 13, wherein the thickness of the deformable member ranges from 0.35 mm to 0.8 mm, and the diameter of the widest part of the deformable member ranges from 5 mm to 10 mm.

15. The pressure regulating device for the writing tool as claimed in claim 11, wherein the outer periphery of the tubular member has an outer sidewall and two annular flanges, the annular flanges being spaced from each other, being formed around and protruding from the outer sidewall of the outer periphery of the tubular member, and abutting on the inner sidewall of the pen tube.

16. The pressure regulating device for the writing tool as claimed in claim 1, wherein an external temperature variation that corresponds to the first predetermined value ranges from 2° C. to 4° C.; and an external temperature variation that corresponds to the second predetermined value ranges from 5° C. to 7° C.

17. The pressure regulating device for the writing tool as claimed in claim 1, wherein X is defined as a diameter of a widest part of the deformable member, Y is defined as a thickness of the deformable member, and a relation between the diameter of the widest part of the deformable member and the thickness of the deformable member is expressed by a formula as follows:

$$Y=0.09X-0.1.$$

18. The pressure regulating device for the writing tool as claimed in claim 17, wherein the thickness of the deformable member ranges from 0.35 mm to 0.8 mm, and the diameter of the widest part of the deformable member ranges from 5 mm to 10 mm.

19. The pressure regulating device for the writing tool as claimed in claim 1, wherein the outer periphery of the tubular member has an outer sidewall and two annular flanges, the annular flanges being spaced from each other, being formed around and protruding from the outer sidewall of the outer periphery of the tubular member, and abutting on the inner sidewall of the pen tube.

20. A writing tool comprising:

a pen tube;

the pressure regulating device as claimed in claim 1; and a nib assembly mounted to an open end of the pen tube and beside an internal chamber of the pen tube;

wherein the deformable member of the pressure regulating device is pressurized in advance, thereby enabling the deformable member for resistance against its deformation toward the external communication chamber of the pen tube.

* * * * *